US009333398B1

(12) United States Patent
Schlapik

(10) Patent No.: US 9,333,398 B1
(45) Date of Patent: May 10, 2016

(54) HANDHELD TETHERED BALL DEVICE

(71) Applicant: Kevin Daniel Schlapik, Fort Lauderdale, FL (US)

(72) Inventor: Kevin Daniel Schlapik, Fort Lauderdale, FL (US)

( * ) Notice: Subject to any disclaimer, the term of this patent is extended or adjusted under 35 U.S.C. 154(b) by 0 days.

(21) Appl. No.: 14/560,955

(22) Filed: Dec. 4, 2014

Related U.S. Application Data

(63) Continuation of application No. 13/425,502, filed on Mar. 21, 2012, now Pat. No. 8,926,331.

(60) Provisional application No. 61/467,259, filed on Mar. 24, 2011.

(51) Int. Cl.

| | |
|---|---|
| ***A63H 33/22*** | (2006.01) |
| ***A63B 43/06*** | (2006.01) |
| ***A63B 43/00*** | (2006.01) |
| ***A63B 43/02*** | (2006.01) |
| ***A63B 37/06*** | (2006.01) |
| ***A63B 37/12*** | (2006.01) |

(52) U.S. Cl.
CPC ..... *A63B 43/06* (2013.01); *A63B 37/06* (2013.01); *A63B 37/12* (2013.01); *A63B 43/007* (2013.01); *A63B 43/02* (2013.01)

(58) Field of Classification Search
USPC ..... 446/219, 220, 228, 247, 252; 473/570, 473/571, 576
See application file for complete search history.

(56) References Cited

U.S. PATENT DOCUMENTS

| | | | | |
|---|---|---|---|---|
| D309,475 | S | 7/1990 | Salehzadeh et al. | |
| 5,236,383 | A * | 8/1993 | Connelly | 446/219 |
| 5,399,136 | A | 3/1995 | Bart | |
| 5,492,335 | A | 2/1996 | Videnov | |
| 5,611,540 | A | 3/1997 | Williams et al. | |
| 6,776,679 | B1 | 8/2004 | Menow | |
| 6,837,808 | B1 * | 1/2005 | Hatch | 473/424 |
| 6,887,188 | B1 | 5/2005 | Davies | |
| 7,186,192 | B1 | 3/2007 | Suissa | |
| 7,361,074 | B1 | 4/2008 | Periman et al. | |
| 8,463,335 | B2 * | 6/2013 | Yang et al. | 455/575.1 |
| 2002/0137582 | A1 | 9/2002 | Yu | |
| 2003/0027484 | A1 | 2/2003 | Kessler | |
| 2007/0032305 | A1 * | 2/2007 | Heinbigner | 473/139 |
| 2014/0315142 | A1 * | 10/2014 | Montgomery | 433/29 |

* cited by examiner

*Primary Examiner* — Kurt Fernstrom
(74) *Attorney, Agent, or Firm* — H. John Rizvi; Gold & Rizvi, P.A

(57) ABSTRACT

The present invention is related to a handheld tethered ball device comprising a tether assembly and a ball unit coupled therewith. The tether assembly includes a cord and a handle, which can be coupled to one another by means of a swivel. The cord preferably ends in a terminal loop that attaches to a ball retention cord protruding from the ball unit. An illumination assembly is included in the ball unit to provide various light emitting patterns. The illumination assembly is powered by batteries. Batteries are concealed by a securable battery cover, which is secured by at least one screw. The illumination assembly is attached to an aperture positioned between retention apertures on the ball unit, to which the ball retention cord is coupled.

19 Claims, 10 Drawing Sheets

HANDHELD TETHERED BALL DEVICE

CROSS-REFERENCE TO RELATED APPLICATIONS

This Non-Provisional Utility Patent Application is a Continuation-In-Part Application claiming priority of U.S. Non-Provisional Utility patent application Ser. No. 13/425,502, filed on Mar. 21, 2012, which in turn claims the benefit of U.S. Provisional Patent Application Ser. No. 61/467,259, filed on Mar. 24, 2011, all of which are incorporated herein in their entirety.

FIELD OF THE INVENTION

The present invention relates generally to the field of entertainment devices. More particularly, the present invention is directed to a soft toy ball that has a tether attached thereto such that ball may be used in various activities such as juggling. The ball further has a light emitting diode (LED) and associated electronics such that the ball may be illuminated from within. Such a device is commonly referred to as a LED-lit Poi ball.

BACKGROUND OF THE INVENTION

"Poi" is a Maori word for 'ball' on a cord; the word "Poi" is also used to refer to the art of managing a ball on a cord, consisting in a form of juggling where the ball is swung around the body for playing, dancing and exercising. Many years ago, Poi was used by the indigenous Maori people of New Zealand to increase their flexibility and strength in their hands and arms as well as to improve coordination. Originally, these Poi balls were related to some dances performed by the Maori female dancers, using balls attached to flax strings, swung rhythmically. The purpose of this dance using balls was basically for keeping their hands flexible. Furthermore, Maori men used Poi to exercise strength and coordination required during a battle.

While, in the beginning, Poi had the purpose of enhancing dance and rhythm, nowadays it is used for several different purposes, including not only entertainment but also for some health-related benefits like increasing wrist strength, increasing body flexibility and improving coordination.

Many types of Poi have been developed over time. For instance, fabric Poi are known where the balls are made of different types of soft fabrics using various attractive colors; plastic bags, sponges and knitting wool may be used in making this type of Poi. Pendulum contact Poi are known, consisting in a set of two Poi which is used combining contact juggling style moves with regular Poi routines; different airwraps, stalls, throws, floaters and pendulum routines can be created. In addition, tailed Poi are known, where the Poi ball incorporates comet tails for an enhanced aesthetic effect, and requires the player to improve the plane control to prevent the tails from tangling. Furthermore, sock Poi are known wherein, instead of using cords, a pair of long knee high socks with a ball inside is used to create the Poi. In another example, fire Poi are known, involving a wick attached to several chains; the fire feature adds not only a visual impact on the user and the audience but also some risk during the spinning of the balls. In a similar but safer example, glow LED (light emitting diode) lighted Poi are known, consisting of a ball that includes an internal battery-powered LED for providing a light feature that enhances the visual attraction of the product.

While known Poi devices are useful, they present several drawbacks. For example, known Poi are generally fabricated of a hard plastic that may injure the user and cause bruising when hitting the body during the learning process of spinning the ball. Further, these known devices do not include an adjustable length cord and do not allow easy modifications of the cord to facilitate various spin motions. Finally these known devices generally have a cord that may bind as the Poi is spun and as a result, the motion of the ball may be adversely affected. In addition, illuminated Poi balls may not provide safe enclosure of the battery or batteries.

Efforts to provide a Poi that overcomes the drawbacks in the prior art have not met with significant success to date. As a result, there is a need in the art for an improved Poi that solves at least one of the aforementioned problems.

SUMMARY OF THE INVENTION

The present invention refers to a handheld tethered ball device or Poi comprising a length-adjustable cord and a preferably illuminated ball unit, fabricated from a compressible/soft material. The ball unit can comprise a battery-powered illumination assembly including a securable battery cover and at least one screw for securing the cover, thus requiring a tool to be used in order to disconnect and open the battery cover, eliminating the risk of children removing and swallowing the batteries. A swivel can couple the length-adjustable cord to a handle, greatly facilitating the execution of certain Poi routines, and in particular, of Orbital tricks.

Introducing a first embodiment of the invention, the present invention consists of a handheld tethered ball device, comprising:

a tether assembly having a first end and an opposing second end;

a ball unit, comprising:

a ball body, an illumination assembly configured to illuminate the ball body, the illumination assembly comprising at least one light source, a battery housing having a cavity for storing at least one battery for powering the at least one light source, and a securable battery cover for selectively concealing the cavity, wherein the securable battery cover is movable relative to the battery housing to adopt a closed position in which the securable battery cover conceals the cavity, and an open position in which the securable battery cover is moved away from the cavity and access to the cavity is granted, wherein at least one screw secures the securable battery cover to the battery housing in the closed position; wherein the tether assembly second end is removably attachable to the ball unit.

In a second aspect, the ball body comprises at least two retention apertures arranged in a spaced-apart configuration, and an aperture arranged between the at least two retention apertures. The ball unit further comprises a ball retention cord coupled to and extending between the at least two retention apertures of the ball body. The illumination assembly is coupled to the aperture arranged between the at least two retention apertures. The tether assembly second end is removably attachable to the ball retention cord.

In another aspect, the tether assembly comprises a terminal loop arranged at the second end, and the ball unit comprises a ball retention cord protruding from an outer surface of the ball unit, wherein the ball retention cord and the ball unit outer surface are arranged in a space-apart configuration for the passing therebetween of the tether assembly terminal loop, and wherein the tether assembly terminal loop is configured to allow passing of the tether assembly first end handle.

In another aspect, the ball retention cord comprises a cord protruding from the ball unit outer surface in a C-shaped configuration.

In another aspect, the tether assembly further comprises:

a handle, arranged at the first end;

a cord, extending to the second end, and removably attachable to the ball unit;

a swivel, coupling the handle to the cord.

In another aspect, the securable battery cover is secured to the battery housing in the closed position by two screws, and the securable battery cover is rotatable relative to the battery housing along a rotation axis provided by one of the two screws when the other of the two screws is removed.

In another aspect, the securable battery cover is hinged to the battery housing.

In another aspect, the securable battery cover is rotatable with respect to the battery housing, and configured to adopt a first rotational position in which the removably battery cover can be radially assembled and disassembled from the battery housing, and a second rotational position in which the securable battery cover is radially locked to the battery housing by at least one latch.

In another aspect, the at least one screw for securing the securable battery cover to the battery housing secures the securable battery cover to the battery housing in the second rotational position.

In another aspect, the illumination assembly further comprises an inner battery cover arranged radially below the securable battery cover, wherein the inner battery cover is removably arranged between the battery housing and the securable battery cover, and access to the inner batter cover is granted by removing the securable battery cover.

In another aspect, the battery housing comprises a main body including an inner body portion and an outer body portion, the inner and outer body portions being arranged in alignment along a radius of the ball body, the inner and outer housing bodies comprising radially aligned cavities for a radially stacked arrangement of the at least one battery and the inner battery cover.

In another aspect, when the securable battery cover is arranged in the closed position, the securable battery cover is in radially-stacked arrangement with the at least one battery and the inner battery cover. In turn, when the securable battery cover is arranged in the open position, the securable battery cover is rotated out of the stacked arrangement.

In another aspect, the ball unit further comprises at least one screw extending between and providing assembly of the inner body portion, the outer body portion and the outer securable battery cover.

Introducing another embodiment of the invention, the present invention consists of a handheld tethered ball device comprising:

a tether assembly having a first end and an opposing second end;

a ball having at least two retention apertures arranged in a spaced-apart configuration;

a ball retention cord coupled to the at least two retention apertures of the ball and extending between the two retention apertures;

an illumination assembly coupled within an aperture positioned between the at least two retention apertures; wherein the tether assembly second end is configured to attach to the ball retention cord.

In a second aspect, the tether assembly further comprises at least one swivel coupled to the first end and/or the second end of the tether assembly In another aspect, the illumination assembly comprises at least one light source, a battery housing having a cavity for storing at least one battery for powering the at least one light source, and a securable battery cover for selectively concealing the cavity, wherein the securable battery cover is removably attachable to the battery housing to adopt a closed position in which the cavity is concealed, and an open position in which access to the cavity is granted, wherein at least one screw secures the securable battery cover to the battery housing in the closed position.

Introducing yet another embodiment of the invention, the present invention consists of a handheld tethered ball device comprising:

a ball body, having an outer surface;

a ball retention cord, protruding from the ball body outer surface in a C-shaped configuration;

a tether assembly having a first end and an opposing second end, the tether assembly comprising:

a handle, arranged at the first end;

a cord, including a terminal loop arranged at the second end; wherein the ball retention cord is configured to allow passing of the tether assembly second end terminal loop between the ball retention cord and the ball outer surface, and wherein the tether assembly second end terminal loop is configured to allow passing of the tether assembly first end handle.

In a second aspect, the terminal loop is integral to the tether assembly cord.

In another aspect, the tether assembly cord comprises an elongated cord body extending between a cord first end and a cord second end, wherein the cord body is looped rearwards forming the terminal loop, and wherein the second end is tied to the cord body in a sliding knot.

In another aspect, the ball retention cord is coupled to and extends between two retention apertures in the ball body, the handheld tethered ball device further comprising an illumination assembly coupled within an aperture positioned between the at least two retention apertures.

For a fuller understanding of the nature and advantages of the present invention, reference should be made to the ensuing detailed description taken in conjunction with the accompanying drawings.

BRIEF DESCRIPTION OF THE DRAWINGS

The components in the figures are not necessarily to scale, emphasis instead being placed upon illustrating the principles of the invention. The invention will now be described, by way of example, with reference to the accompanying drawings, in which.

Like reference numerals designate corresponding parts, elements or features throughout the different views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. In other implementations, well-known features and methods have not been described in detail so as not to obscure the invention. For purposes of description herein, the terms "upper", "lower", "left", "right", "front", "back", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
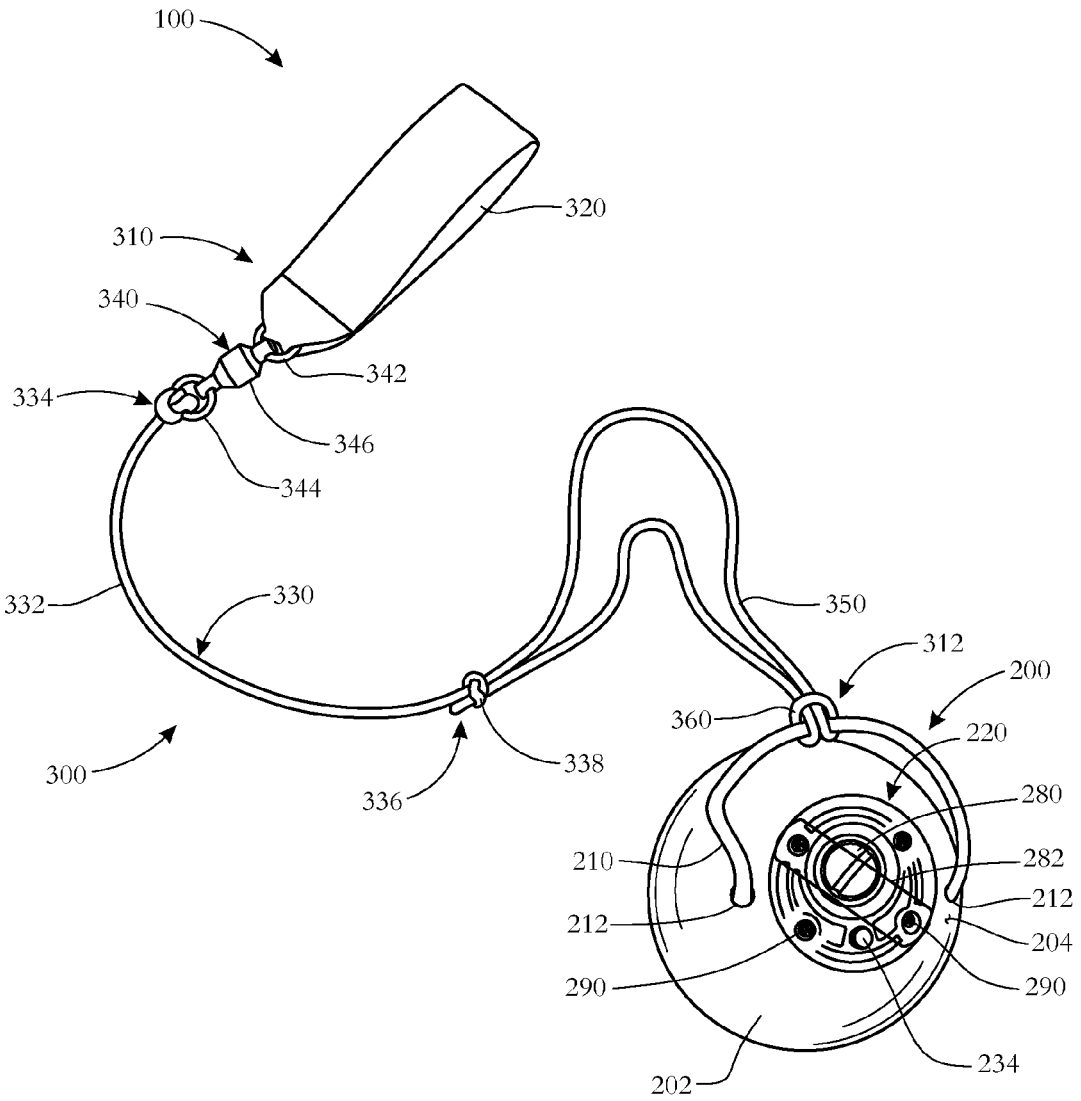
FIG. 1 presents a perspective view of a tethered ball device or Poi in accordance with a first exemplary embodiment of the present invention, the device comprising a ball unit and a tether assembly.

The illustration of FIG. 1 depicts an exemplary embodiment of a handheld tethered ball device 100 in accordance with the invention, generally comprising a ball unit 200 and a tether assembly 300. The ball unit 200 of the present embodiment comprises a generally hollow spherical body 202 having an outer surface 204. The tether assembly 300, in turn, presents a first end 310 and an opposing second end 312, wherein a handle 320 is arranged on the tether assembly first end 310. Handle 320 may be fabricated from nylon webbing or other strap-like material that provides a strong resistance to longitudinal tension and torsion. A cord 330 extends from the handle 320 to the tether assembly second end 312, and is attached to the ball unit 200. Cord 330 may be fabricated from woven nylon or other materials that are capable of sustaining adequate tension loading when the tethered ball device 100 is in use. In accordance with the invention, the cord 330 is not directly attached to the handle 320; instead, a swivel 340 is arranged between the handle 320 and the cord 330, coupling the cord 330 to the handle 320 in a rotational configuration as indicated by arrow A of FIG. 8. Such a rotational coupling between handle 320 and cord 330 is extremely advantageous when practicing certain types of Poi routines, as it prevents the user from having to twist his or her wrist excessively; a person skilled in the art will understand that repetitive twisting or torsion could damage the muscles, tendons, or other parts of the wrist. In addition, in the event two Poi are simultaneously used (such as when performing a Poi routine known as "Orbital"), the swivel helps prevent the Poi cords from twisting and binding.

Figure 4:
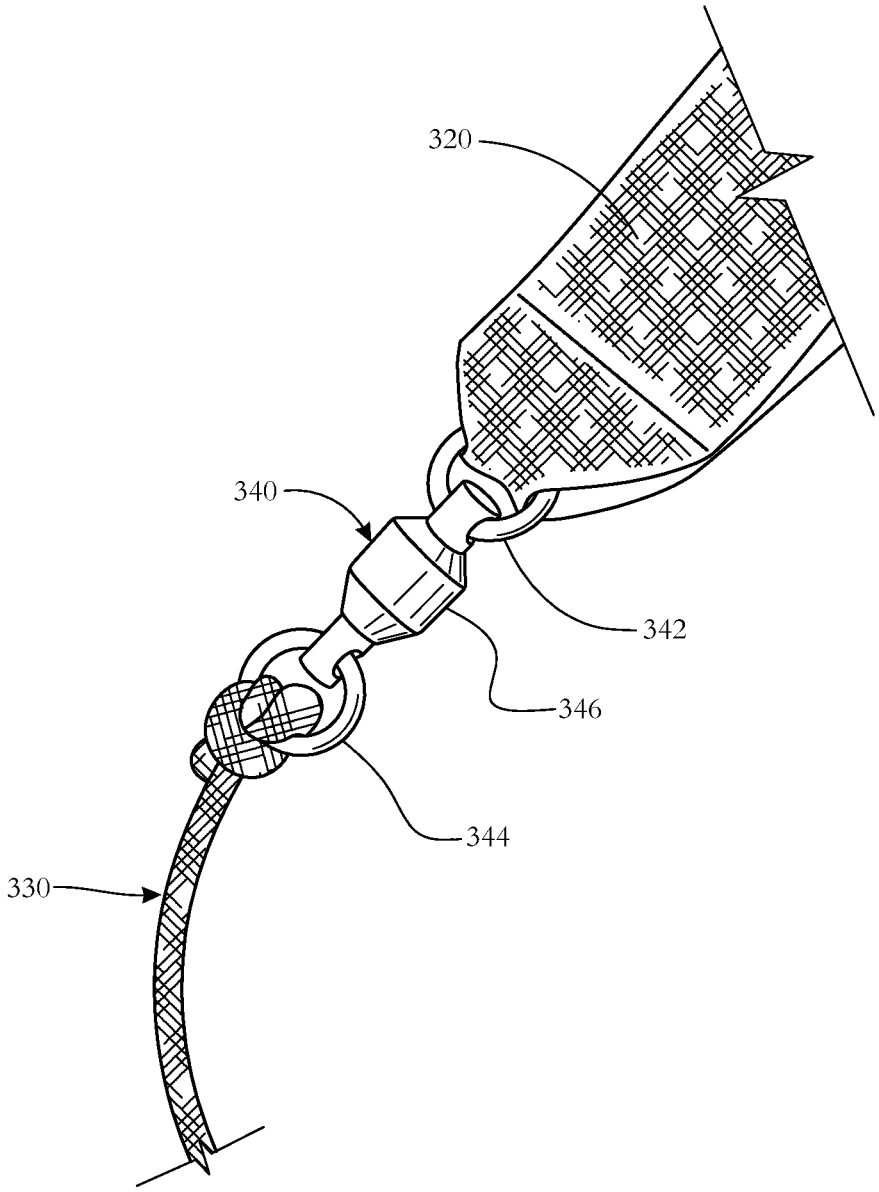
FIG. 4 presents an enlarged perspective view of the swivel, handle and cord arrangement of the tethered ball device of FIG. 1.

In the present embodiment, handle 320 consists of folded strap forming a single planar loop. The swivel 340, as best shown in the enlarged view of FIG. 4, comprises two split rings 342, 344. One split ring 342 is attached to an end of the planar loop. In turn, the other split ring 344 is attached to cord 330. A swiveling body 346 is arranged between the split rings 342, 344, providing independent rotation of the split rings 342, 344. The present swivel 340 is exemplary, and the invention contemplates the use of alternative swivels that provide relative rotation between the handle 320 and the cord 330.

As shown in FIG. 1, the tether assembly 300 comprises a terminal loop 350 arranged at the second end 312. In the present embodiment, the terminal loop 350 is integral to the cord 330, optimizing the amount of components and materials required to manufacture the tether assembly 300, and thus contributing to reduce the cost of the device. For instance, in the present embodiment, cord 330 comprises an elongated body 332 extending between a cord first end 334 and a cord second end 336, where the cord first end 334 is coupled to the swivel 340; in addition, as shown in FIG. 1, the cord body 332 is looped rearwards, and the cord second end 336 is tied to the cord body 332 in a sliding knot 338, the rearward looped cord body 332 thereby forming the terminal loop 350. Having a terminal loop 350 integral to the cord 330 and delimited by a sliding knot 338 provides length-adjustability of tether assembly 300 using a reduced number of components. In consequence, risk of failure is reduced and reliability is increased accordingly. In addition, length-adjustability is provided at reasonable cost, allowing the generality of users to benefit from being able to adapt the tethered ball device 100 length to their body height and arm.

Figure 5:
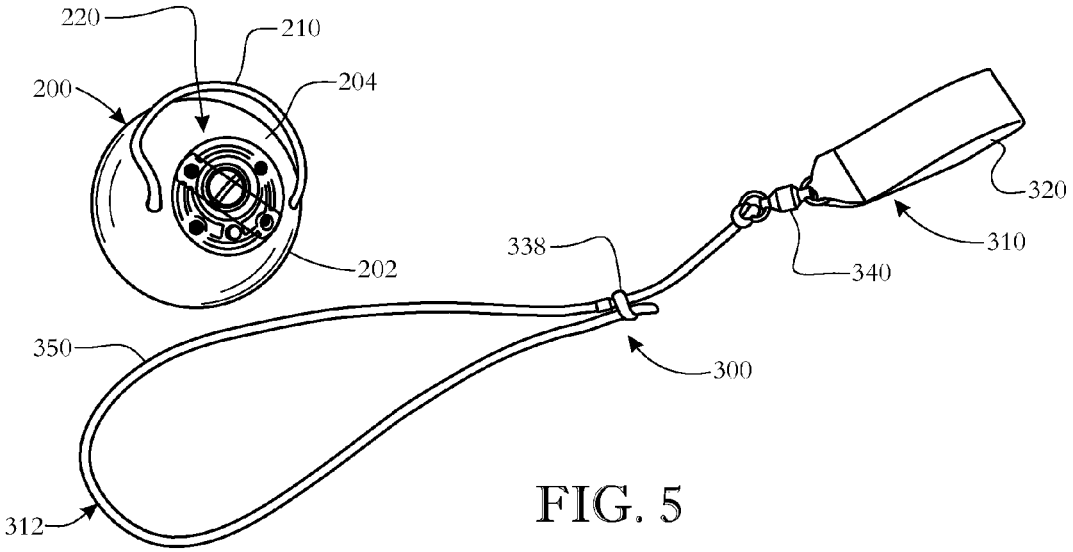
FIG. 5 presents the ball unit and the tether assembly of FIG. 1, in a first situation in which the tether assembly is detached from the ball unit.
Figure 6:
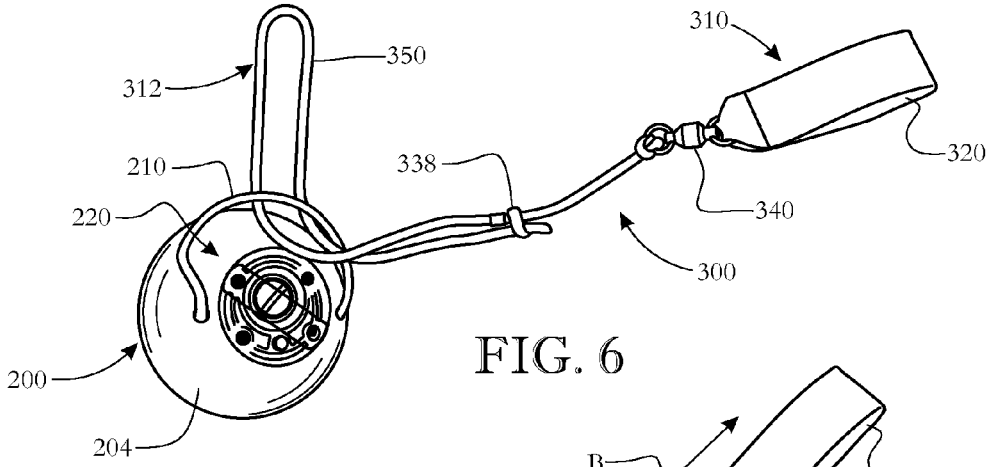
FIG. 6 presents the ball unit and the tether assembly of FIG. 1, in a second situation in which the cord terminal loop is partially engaged with the ball unit ball retention cord.
Figure 7:
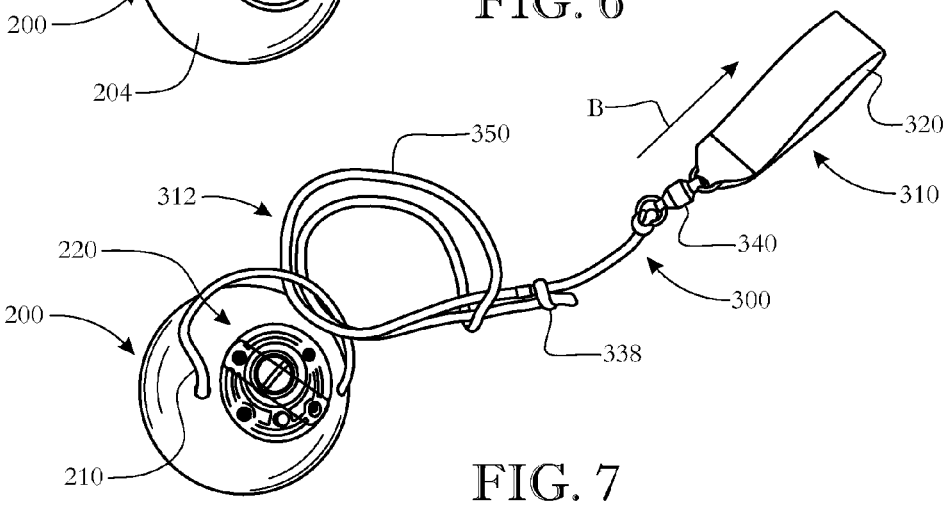
FIG. 7 presents the ball and the cord of FIG. 1, in a third situation in which the tether assembly handle has been inserted through the cord terminal loop.

With continued reference to FIG. 1, ball unit 200 comprises a ball retention cord 210 protruding from the ball unit body outer surface 204. The ball retention cord 210 is coupled to at least two retention apertures 212 on the ball unit body 202, the retention apertures 212 being arranged in a spaced-apart configuration. In the present embodiment, the ball unit body 202 specifically includes two retention apertures 212, and the ball retention cord 210 consists of a cord protruding from the two retention apertures 212 and the ball unit body outer surface 204 in a C-shaped or bridge-like configuration. The ball retention cord 210 or C-shaped cord is arranged sufficiently loosely for a space 220 to be formed between the ball retention cord 210 and the ball unit body outer surface 204. In the present embodiment, the space 220 is large enough for the tether assembly terminal loop 350 to pass through; in addition, complementarily, the tether assembly terminal loop 350 is configured to allow passing of the tether assembly first end handle 320. Such an arrangement facilitates attaching the tether assembly 300 to the ball unit 200, as shown in FIGS. 5 through 7, which depict a simple three-step attaching sequence in accordance with the invention. In an initial situation, as illustrated in FIG. 5, the tether assembly 300 is placed in near proximity of the ball unit 200, specifically by setting the terminal loop 350 near the ball unit ball retention cord 210. Then, as shown in FIG. 6, the user inserts the tether assembly terminal loop 350 through the space 220 delimited between the ball unit ball retention cord 210 and the ball unit body outer surface 204. Finally, as shown in FIG. 7, the user inserts the tether assembly handle 320 through the terminal loop 350 and pulls the handle 320 away from the ball unit 200 as indicated by arrow B. Sufficient pulling of the handle 320 causes the terminal loop 350 to tighten around the ball unit ball retention cord 210, forming a securing knot 360 as shown in FIG. 1.

Several advantages arise from the tethered ball device 100 and method of assembly heretofore described with respect to FIGS. 5, 6, 7 and 1. Firstly, attaching and removing the tether assembly 300 to and from the ball unit 200 can be carried out easily and quickly. In addition, the coupling between tether assembly 300 and ball unit 200 is increased or strengthened when using the Poi, as centrifugal force caused by rotation of ball unit 200 keeps the terminal loop securing knot 360 tight, thus minimizing the risk of the ball unit 200 breaking loose from the tether assembly 300 while a Poi routine is being performed. Furthermore, the present attaching system based on a terminal loop securing knot 360 optimizes the number of components required for its construction, contributing to a reasonable device manufacture cost and to a reduced risk of failure.

Figure 2:
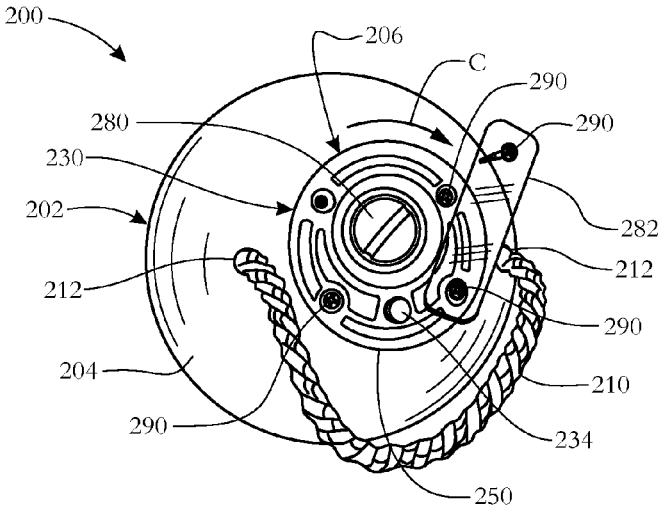
FIG. 2 presents a perspective view of the ball unit of FIG. 1, shown in a position in which the outer securable battery cover is partially rotated to unveil the inner battery cover for selectively preventing access to the batteries powering the device.
Figure 3:
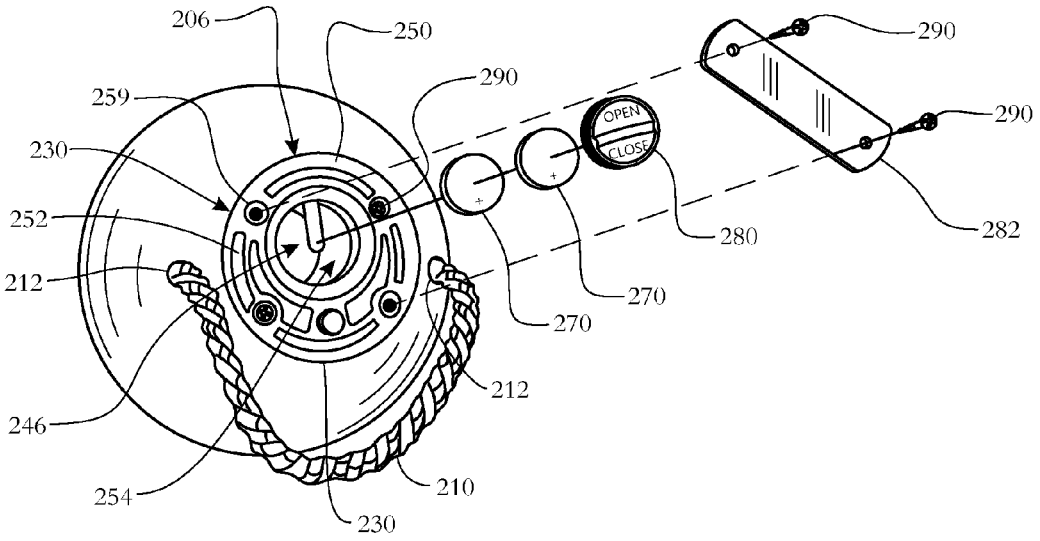
FIG. 3 presents a perspective view of the ball unit of FIG. 1, were the outer securable battery cover, the outer securable battery cover fastening screws, the battery cover and the batteries are shown in exploded format.
Figure 9:
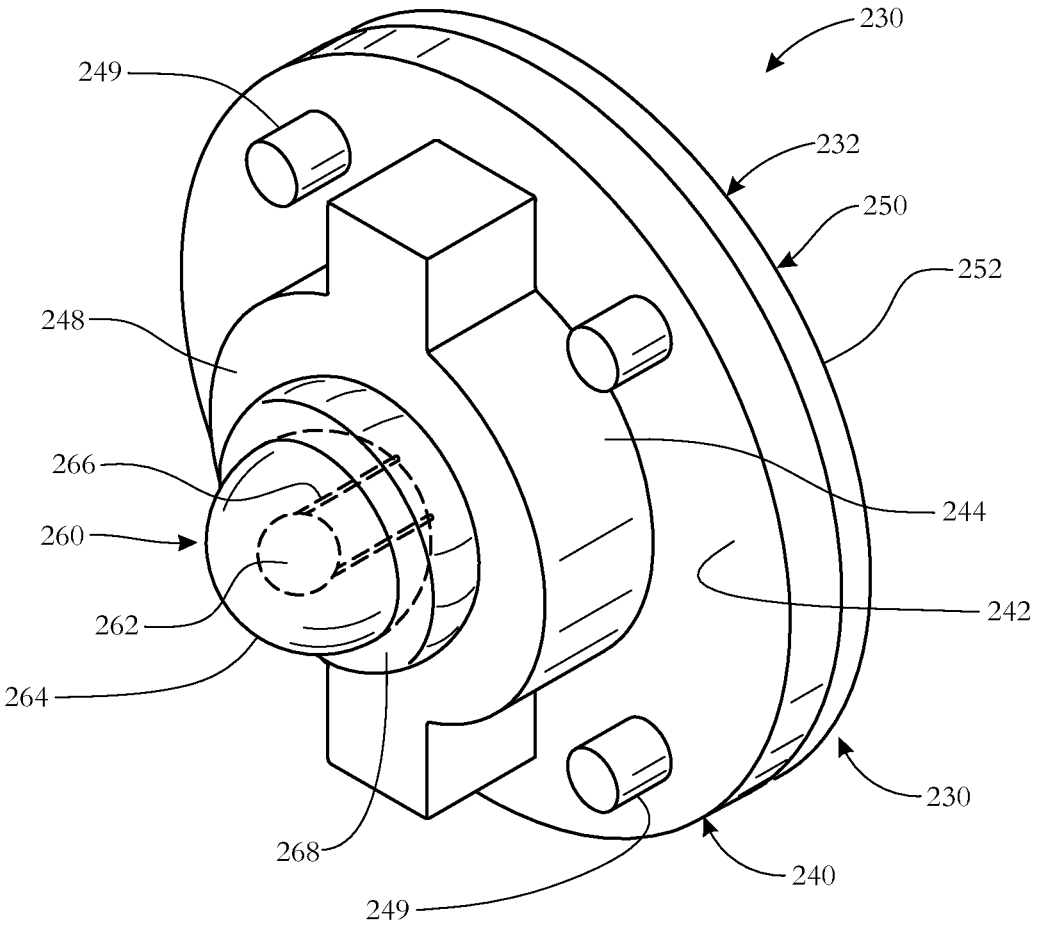
FIG. 9 presents a perspective view of the light source housing, viewed from inside the ball unit spherical body.

The handheld tethered ball device 100 of the present embodiment is also characterized in that the ball unit 200 is capable of becoming illuminated, to enhance the visual effect of the Poi routine. The illustrations of FIGS. 2, 3 and 9 allow for a better understanding of the components involved in illuminating the ball unit 200. As shown in FIG. 2, the ball unit body 202 comprises an aperture 206 positioned between the at least two spaced-apart retention apertures 212. An illumination assembly 230 is coupled to the aperture 206. The illumination assembly 230 extends from inside the ball unit body 202 to outside the ball unit body 202. As best shown in FIG. 9, the illumination assembly 230 includes a main body 232; the main body 232 of the present embodiment is formed of an inner body portion 240 and an outer body portion 250. The outer body portion 250 presents a generally disc-shaped base 252 provided with a cavity 254, as best shown in FIG. 3. In turn, the inner body portion 240 features a disc-shaped base 242 from which a cylindrical receptacle 244 protrudes inwardly within the ball unit body 202, as best shown in FIG. 9. The cylindrical receptacle 244 presents an inner cavity 246, as best shown in FIG. 3. The inner and outer housing bodies 240, 250 are arranged in radial alignment, i.e. aligned along a radius of ball unit 200, so that the outer body portion 250 is on top, and external to, the inner body portion 240, and the outer housing disc-shaped base 252 rests against the inner housing disc-shaped base 242, as best shown in FIG. 9. As can be observed in FIG. 3, the inner and outer cavities 246, 254 are preferably radially aligned, i.e., the outer housing cavity 254 is arranged over and in radial continuation of the inner cavity 246.

For providing illumination, the ball unit 200 includes a light source 260 (such as an—Light-Emitting Diode (LED)-based light source), which protrudes outwardly from a base surface 248 of the inner body portion cylindrical receptacle 244, and inwardly to the ball unit body 202. In addition, as shown in FIG. 3, ball unit 200 includes two button cell batteries 270 for powering the light source. The batteries 270 are electrically connected to an electronic circuitry within the main body 232 of the illumination assembly 230. One of ordinary skill in the art will understand that several types of electronic circuit designs may be employed to construct the present invention; these various circuits will not be described in detail so as not to obscure the invention. The aligned inner and outer body portion cavities 246, 254 form a battery holder compartment for housing the batteries 270. A removable inner battery cover 280 is further included for selectively preventing access to the battery holder compartment formed by cavities 246, 254. It is contemplated that battery cover 280 may be mechanically coupled to the main body 232 by one or more mechanical fastening configurations such as mating threaded engagement, snap-fit engagement, press-fit engagement or combinations thereof. Finally, an outer securable battery cover 282 is arranged externally to the inner battery cover 280, and is configured to selectively prevent access to the inner battery cover 280. The outer securable battery cover 282 is attached to the outer body portion 250 of the illumination assembly main body 230 by at least one screw 290 (two screws 290, in the present embodiment). Thus, batteries 270 are protected by a double-cover safety system, whereby a second, outer securable battery cover 282 prevents access to a first, inner battery cover 280. Such an arrangement, together with the fact that the outer securable battery cover 282 is fastened by at least one screw, prevents children from accessing the inner battery cover 280 and eventually extracting—and swallowing—the button cell batteries 270.

As understood by FIG. 3, the aligned cavities 246, 254 are configured to house the pair of batteries 270 and the inner battery cover 280 in a stacked configuration in which a bottom battery 270 is arranged on top of the electronic circuitry, a top battery 270 is arranged on top of the bottom battery 270, and the inner battery cover 280 is disposed over the topmost battery 270. The outer securable battery cover 282 is rotatably coupled to the outer body portion 250 and configured to adopt a closed position (as shown in FIG. 1) in which the outer securable battery cover 282 is in stacked arrangement with the batteries 270 and the inner battery cover 280. In addition, the outer securable battery cover 282 can adopt an open position (as shown in FIG. 2) in which the outer securable battery cover 282 is rotated out of the aforementioned stacked arrangement, as indicated by arrow C of FIG. 2, granting access to the inner battery cover 280. In order to facilitate rotation of the outer securable battery cover 282, the inner battery cover 280 is preferably disposed flush or radially inwards relative to an outer surface of the outer body portion 250. Having a rotatable outer securable battery cover 282 is advantageous in that access can be granted to the outer securable battery cover 282 without the need of fully removing the outer securable battery cover 282, thereby minimizing the risk of misplacing and losing the outer securable battery cover 282.

Preferably, as shown, ball unit 200 further comprises several screws 290 extending between and providing assembly of the inner body portion 240, the outer body portion 250. More specifically, the present embodiment includes four screws 290 that pass through respective orifices 259 of the outer body portion 250 (as shown in FIG. 3), and into cavities formed inside respective posts 249 protruding outwardly from the inner body portion disc-shaped base 242 (as shown in FIG. 9). In addition, as shown in FIG. 3, two opposed screws 290 further engage the outer securable battery cover 282, thus contributing to minimize the number of components comprised in the device. Either one of the screws 290 attaching the outer securable battery cover 282 also provide a turning axis on which the outer securable battery cover 282 can rotate, provided that the opposed screw 290 is previously unthreaded as shown in FIG. 2. Thus, the two screws 290 attaching the outer securable battery cover 282 serve both as attachments and as turning axes of the battery cover 282, this dual function allowing to save materials and reduce the number of components required to manufacture the device.

In certain embodiments, as shown in FIG. 9, the ball unit light source 260 protrudes radially inwards from the inner body portion 240. For example, the light source 260 of the present embodiment comprises a LED 262 covered by a translucent cover 264, where both the LED 262 and the translucent cover 264 are connected to the electronic circuitry by means of two wires or pins 266; as shown, LED 262 and translucent cover 264 protrude from the inner body portion 240 towards the center of the ball unit body 202. The inner body portion 240 further comprises a transverse retainer 268 arranged to prevent lateral vibration or swaying of the protruding light source 260 caused by acceleration, deceleration and/or centrifugal forces withstood by the ball unit 200 during execution of a Poi routine. Preferably, as shown, the transverse retainer 268 is arranged around the entire perimeter of the protruding light source 260, in a collar-like configuration, to prevent the light source from vibrating or swaying in any lateral direction. In certain embodiments, the transverse retainer 268 can be made of an adhesive, a bonding agent, an elastomeric seal or gasket, or the like.

The ball unit body 202 is preferably fabricated as a compressible substantially hollow spherical ball made of soft translucent plastic or rubber-like material. Any of a wide variety of other known materials, such as silicone or vinyl, may also be utilized without departing from the present invention. It is desirable to fabricate the ball unit body 202 out of a material that is compressible and soft so that injury to the user is prevented during use should the user accidentally hit himself/herself when learning how to use the tethered ball device 100. It is contemplated that the material used to fabricate the ball unit body 202 be translucent so that light source 260 disposed within ball unit body 202 may illuminate the ball unit body 202 from within.

It is contemplated that in one exemplary embodiment, ball unit 200 comprises a user-operable actuator 234, such as an ON-OFF button or switch, which a user may actuate to turn the light source 260 on or off, and thereby control when the tethered ball device 100 emits light therefrom. In one exemplary embodiment, the user turns the light source 260 on by depressing the user-operable actuator 234 or button one time and turns the light source 260 off by holding the user-operable actuator 234 or button down in depressed state until the light source 260 no longer emits light. It is contemplated that various light emitting patterns may be implemented into the circuitry of ball unit 200. In alternative embodiments, the device can include more than one user-operable actuator, where each user-operable actuator can control different illumination patters, illumination timers, light intensity, light color, or the like.

Figure 8:
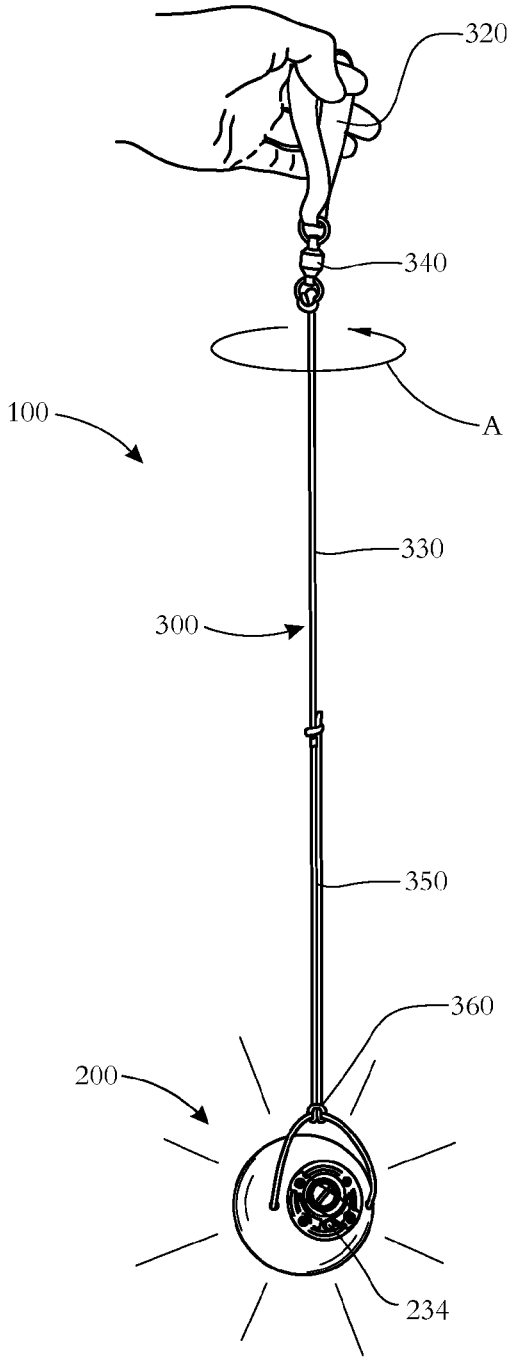
FIG. 8 presents the tethered ball device of FIG. 1 in use, illustrating the rotation of the ball unit and cord relative to the handle, by means of the swivel, preventing binding when performing an Orbital technique.

In operation, a user holds the handle 320 by normally placing one or more fingers in the handle strap loop as illustrated in FIG. 8. The user then may actuate the user-operable actuator 234 of the ball unit 200 into a desired light emitting pattern. Next the user may then enjoy the use of the tethered ball device 100 by spinning the ball unit 200 as desired and commonly employed by traditional Poi methods. The swivel 340 prevents undesired binding/twisting of cord 330 and permits ball unit 200 to spin freely with respect thereto.

Figure 10:
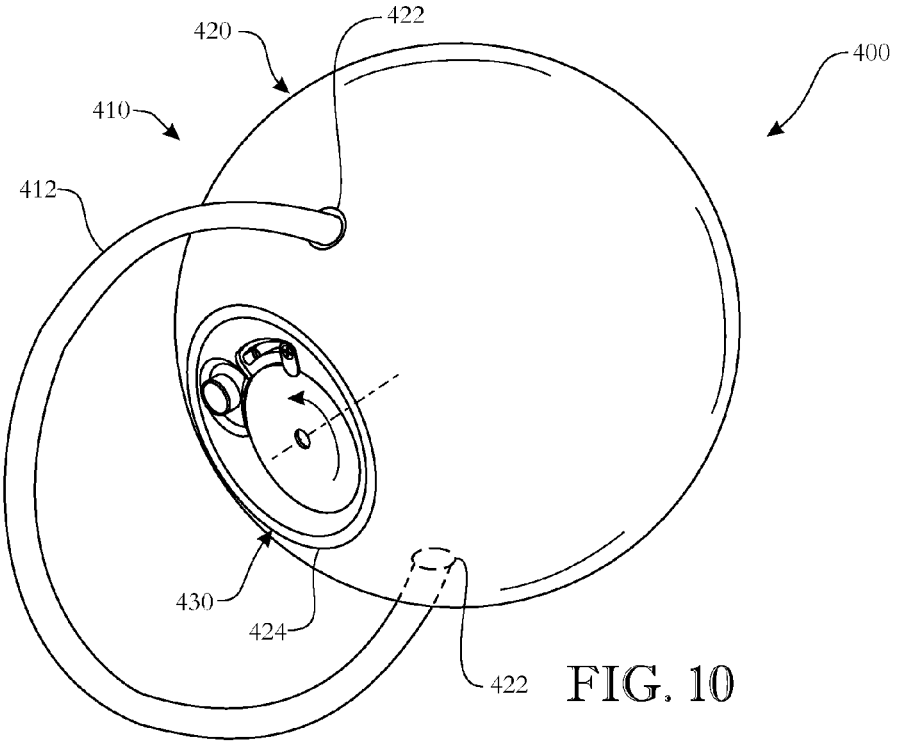
FIG. 10 presents a perspective view of a tethered ball device ball unit in accordance with a second exemplary embodiment of the present invention, the ball unit shown assembled.

The illustration of FIG. 10 presents a second embodiment of the invention, consisting in an illuminated handheld tethered ball device 400 comprising a tether assembly—not shown—and a ball unit 410. The ball unit 410 includes a ball body 420 and an illumination assembly 430. The ball body 420 presents two spaced-apart retention apertures 422 and an intermediate aperture 424 arranged between the spaced-apart retention apertures 422. A ball retention cord 412 is coupled to the two retention apertures 422 and is arranged in an arched, C-shaped or bridge-like configuration relative to an outer surface of the ball body 420. The illumination assembly 430, in turn, is configured to illuminate the ball body 420 from within. As shown, the illumination assembly 430 is coupled to the intermediate aperture 424, and the bridge-like ball retention cord 412 is arranged over the illumination assembly 430. The tether assembly—not shown—attaches to the ball retention cord 412 such as in the manner of the previous embodiment.

Figure 11:
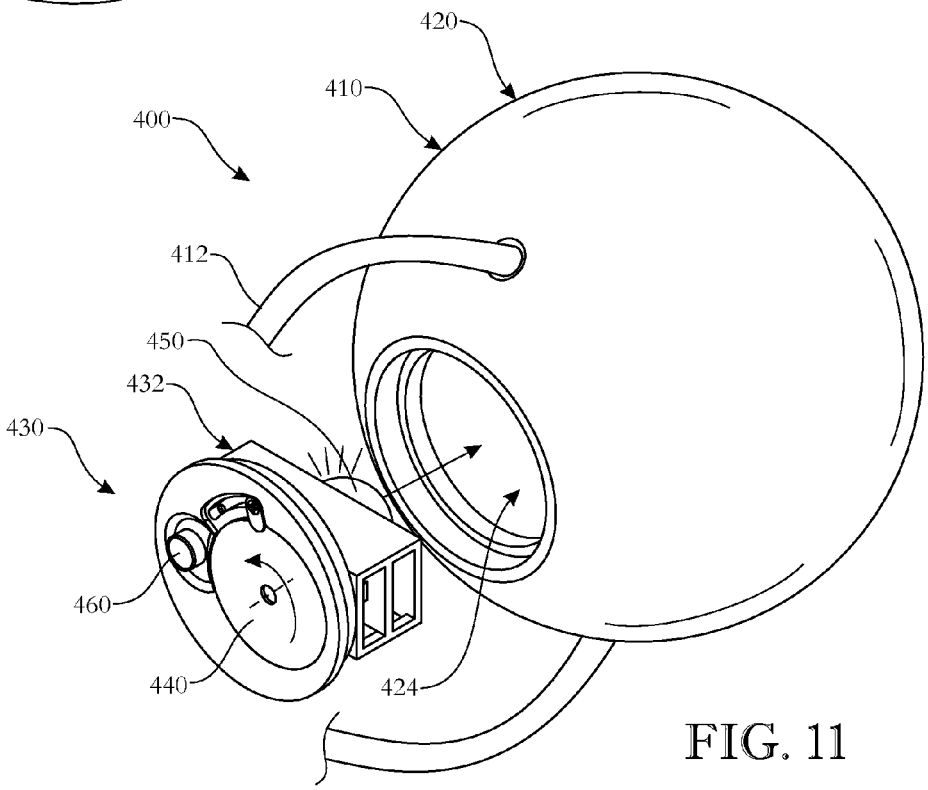
FIG. 11 presents a perspective view of the ball unit of FIG. 10, showing the ball and illumination assembly disassembled from one another.
Figure 12:
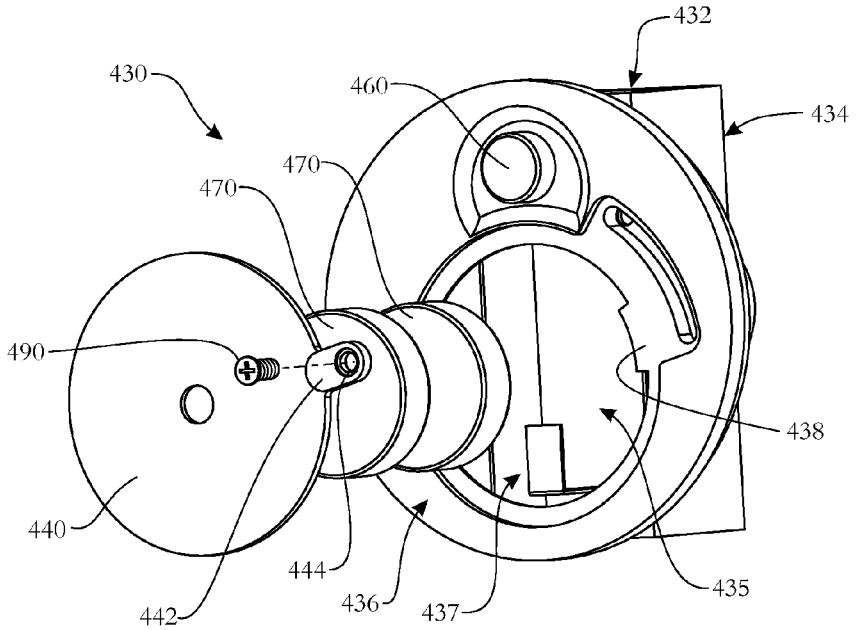
FIG. 12 presents an exploded perspective view of the illumination assembly of the ball unit of FIG. 10.
Figure 13:
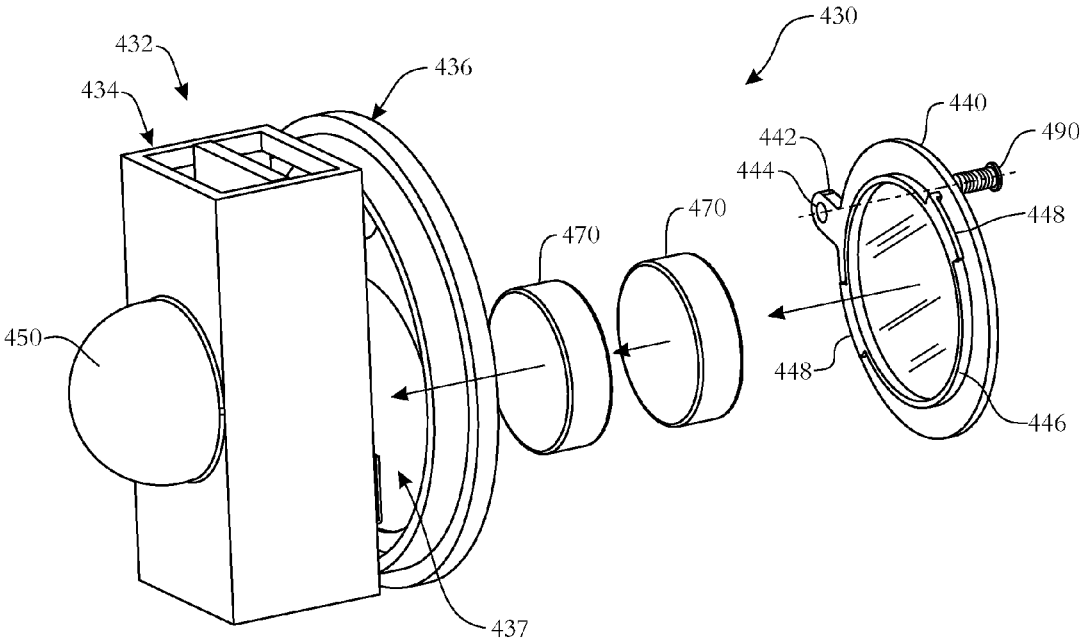
FIG. 13 presents another exploded perspective view of the illumination assembly of FIG. 12, shown from a different angle.

The illustration of FIG. 11 shows the illumination assembly 430 detached from the ball body 420, thus revealing the intermediate aperture 424. As can be seen, the illumination assembly 430 includes a main body 432, a securable battery cover 440, a light source 450 and a user-operable actuator 460. In addition, the illumination assembly 430 comprises electronic circuitry—not shown—to selectively power the light source 450 using power from one or more batteries stored within the main body 432, in dependence of user operation of the user-operable actuator 460. The illustrations of FIGS. 12 and 13 present two enlarged exploded views of the illumination assembly 430. As shown, the illumination assembly main body 432 comprises an inner portion 434 and an outer portion 436. The inner portion 434 includes an inner cavity 435 for housing two batteries 470. In turn, the outer portion 436 includes an aperture 437 for providing access to the inner cavity 435 of the inner portion 434. When the illumination assembly 430 is assembled, the batteries 470 and the securable battery cover 440 are radially stacked, similarly to the previous embodiment.

The securable battery cover 440 of the present embodiment presents a transverse flange 442 including an opening 444. A screw 490 is configured to pass through the opening 444 and to secure the securable battery cover 440 to the outer portion 436 of the main body 432 of the illumination assembly 430.

Figure 14:
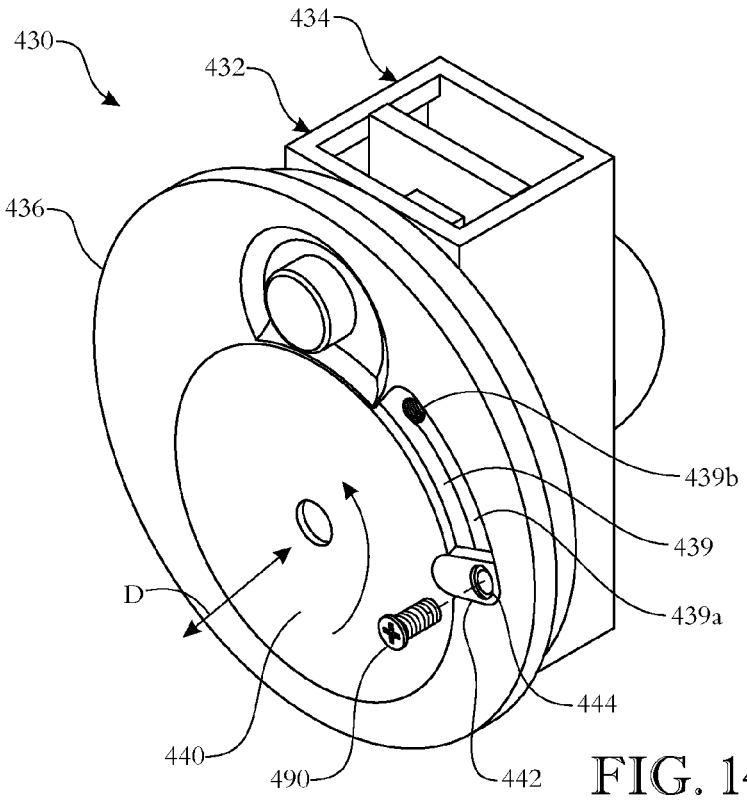
FIG. 14 presents a perspective view of the illumination assembly of FIG. 12, shown in a first rotational position in which the securable battery cover has been placed on the illumination assembly main body and can be removed from the illumination assembly main body.
Figure 15:
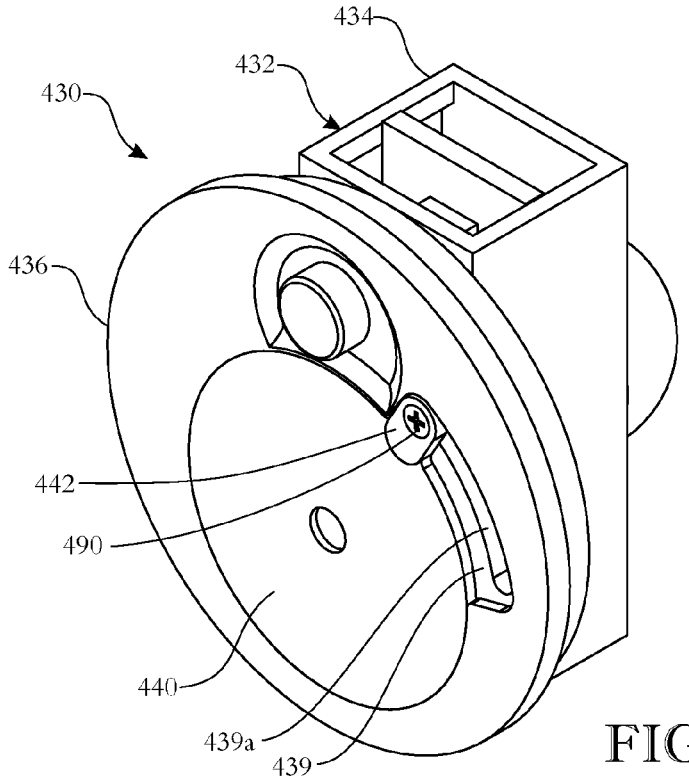
FIG. 15 presents a perspective view of the illumination assembly of FIG. 12, shown in a second rotational position in which the securable battery cover has been rotated counterclockwise a predetermined angle, and the attachment screw has been threaded to the illumination assembly main body in order to secure the securable battery cover to the illumination assembly main body.

The securable battery cover 440 further includes a neck portion 446 from which at least one inner transverse flange 448 extends outwardly (the present embodiment, in particular, includes two inner transverse flanges 448). The securable battery cover 440 is rotatable with respect to the illumination assembly main body 432, and configured to adopt several rotational positions relative to the illumination assembly main body. In a first rotational position, shown in FIG. 14, the neck portion 446 and the inner transverse flanges 448 are configured to fit through the aperture 437 of the outer portion 436 of the main body 432; thus, in this first position, the securable battery cover 440 can be assembled or disassembled from the main body 432 by moving the securable battery cover 440 in a forward or rearward direction as indicated by arrow D. In a second position, shown in FIG. 15, the inner transverse flanges 448 are arranged behind corresponding latches 438 protruding radially into the aperture 437; thus, in this second rotational position, the securable battery cover 440 is radially locked to the main body 432, i.e., cannot be pulled out from the main body 432. As shown in FIGS. 14 and 15, the outer portion 436 of the main body 432 includes an arc-shaped channel 439 through which the transverse flange 442 may move when rotating from the first rotational position to the second rotational position, and vice versa. The arc-shaped channel 439 includes an inner channel space 439*a* for allowing the tip of the screw 490 to travel, and a threaded hole 439*b* configured to threadingly receive the screw 490 when the securable battery cover 440 is in the second rotational position.

Figure 16:
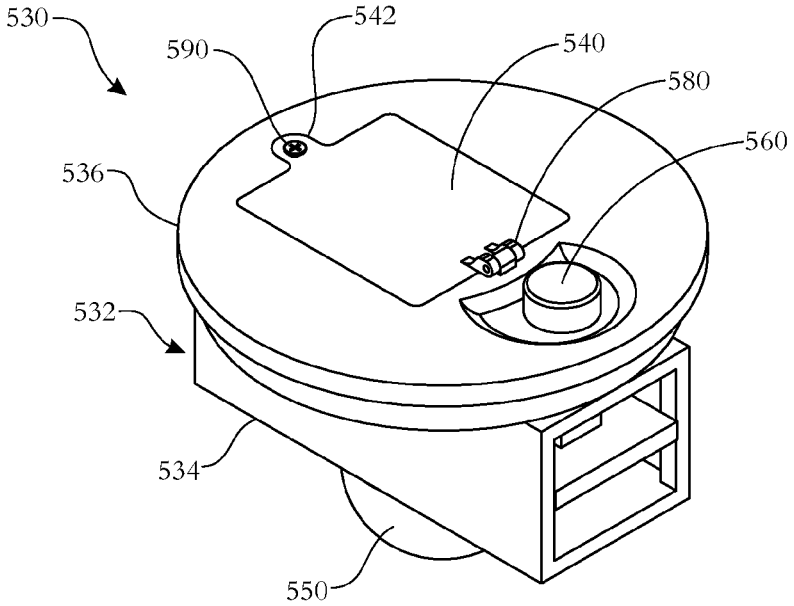
FIG. 16 presents a perspective view of a tethered ball device illumination assembly in accordance with a third exemplary embodiment of the present invention, the illumination assemble comprising a hinged securable battery cover, the hinged securable battery cover being shown in a closed position.
Figure 17:
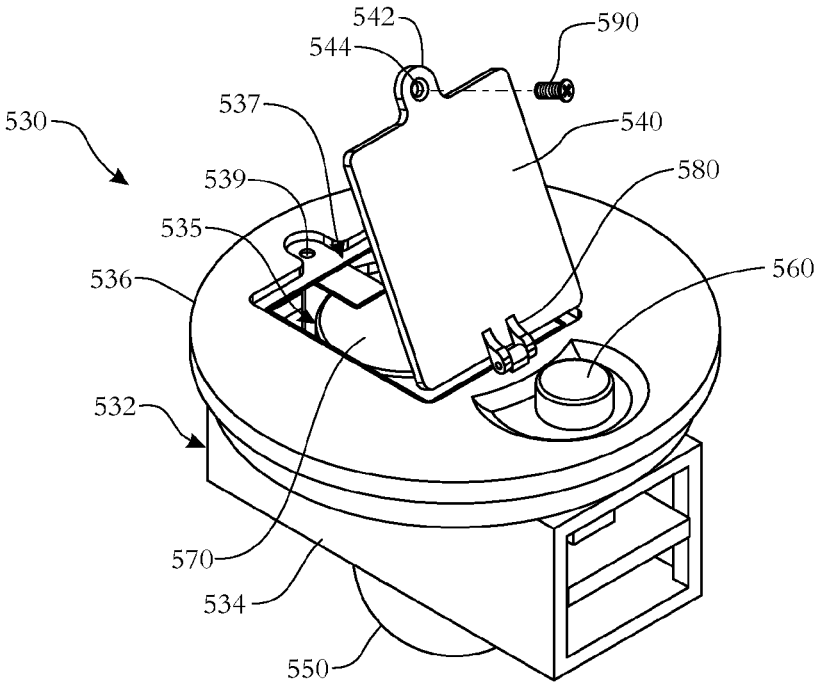
FIG. 17 presents a perspective view of the illumination assembly of FIG. 16, the hinged securable battery cover being shown in an opened position.

The illustrations of FIGS. 16 and 17 present an alternative illumination assembly 530 in accordance with a third embodiment of the present invention. The illumination assembly 530 is used to illuminate a tethered ball body from within, similarly to the previous embodiments. The illumination assembly 530 includes a main body 532, a securable battery cover 540, a light source 550 and a user-operable actuator 560. In addition, the illumination assembly 530 comprises electronic circuitry—not shown—to selectively power the light source 550 using power from one or more batteries stored within the main body 532, in dependence of user operation of the user-operable actuator 560. The main body 532 includes an inner portion 534 and an outer portion 536. The securable battery cover 540 is pivotably attached to the outer portion 536 by a hinge 580. The illustration of FIG. 16 shows the securable battery cover 540 in a closed position in which the securable battery cover 540 is pivoted towards the outer portion 536, preventing access to inside the main body 532. The illustration of FIG. 17 shows the securable battery cover 540 in an opened position, in which the securable battery cover 540 has pivoted about the hinge 580, revealing an aperture 537 of the outer portion 536, and a set of batteries 570 stored in an inner cavity 535 arranged in radial registration with the aperture 537. The securable battery cover 540 includes a flange 542 provided with an opening 544. In turn, the main body outer portion 536 includes a threaded hole 539 configured to align with the opening 544 of the securable battery cover 540 when the securable battery cover 540 is in the closed position (FIG. 16). In the closed position, the securable battery cover 540 is secured to the main body 532 by inserting a screw 590 through the opening 544 and threading the screw 590 into the threaded hole 539.

As will be now apparent to those skilled in the art, a tethered illuminated ball fabricated according to the teachings of the present invention is capable of substantially increasing the enjoyment of participating in various Poi activities. Firstly, children's safety is guaranteed by having the battery cover secured by one or more screws. In addition, the present invention reduces the binding and twisting of the tether, especially when carrying certain Poi routines (e.g., Orbital tricks), by employing a swivel disposed between a handle of the tether assembly and the spherical ball at the opposing end. Further, the invention provides a tether assembly that may easily be adjusted to a desired length. Finally, the invention provides a tether assembly that may be easily decoupled from the spherical ball.

Although the above provides a full and complete disclosure of the preferred embodiments of the invention, various modifications, alternate constructions and equivalents will occur to those skilled in the art. Therefore the above should not be construed as limiting the invention, which is defined by the appended claims and their legal equivalence.

What is claimed is:

1. A handheld tethered ball device, comprising:

a tether assembly having a first end and an opposing second end;

a ball unit, comprising:

a ball body, illumination assembly configured to illuminate the ball body, said illumination assembly comprising at least one light source, a battery housing having a cavity for storing at least one battery for powering said at least one light source, and a securable battery cover for selectively concealing said cavity, wherein said securable battery cover is movable relative to said battery housing to adopt a closed position in which the securable battery cover conceals the cavity, and an open position in which the securable battery cover is moved away from the cavity and access to the cavity is granted, wherein at least one screw secures the securable battery cover to the battery housing in the closed position; wherein said tether assembly second end is removably attachable to said ball unit; wherein said tether assembly further comprises a terminal loop arranged at said second end, and wherein said ball unit comprises a ball retention cord protruding from an outer surface of said ball unit, wherein said ball retention cord and said ball unit outer surface are arranged in a space-apart configuration for the passing therebetween of said tether assembly terminal loop, and wherein said tether assembly terminal loop is configured to allow passing of said tether assembly first end handle.

2. The device of claim 1, wherein:

said ball body comprises at least two retention apertures arranged in a spaced-apart configuration, and an aperture arranged between said at least two retention apertures;

said ball unit further comprising a ball retention cord coupled to and extending between said at least two retention apertures of said ball body; wherein the illumination assembly is coupled to said aperture arranged between said at least two retention apertures; and wherein the tether assembly second end is removably attachable to said ball retention cord.

3. The device of claim 1, wherein said ball retention cord comprises a cord protruding from said ball unit outer surface in a C-shaped configuration.

4. The device of claim 1, wherein the tether assembly further comprises:

a handle, arranged at said first end;

a cord, extending to said second end, and removably attachable to said ball unit;

a swivel, coupling said handle to said cord.

5. The device of claim 1, wherein said securable battery cover is secured to said battery housing in the closed position by two screws, and wherein the securable battery cover is rotatable relative to said battery housing along a rotation axis provided by one of said two screws when the other of said two screws is removed.

6. The device of claim 1, wherein said securable battery cover is hinged to said battery housing.

7. The device of claim 1, wherein said securable battery cover is rotatable with respect to said battery housing, and configured to adopt a first rotational position in which the removably battery cover can be radially assembled and disassembled from said battery housing, and a second rotational position in which the securable battery cover is radially locked to said battery housing by at least one latch.

8. The device of claim 7, wherein the at least one screw for securing the securable battery cover to the battery housing secures the securable battery cover to the battery housing in the second rotational position.

9. The device of claim 1, wherein said illumination assembly further comprises an inner battery cover arranged radially below said securable battery cover, wherein said inner battery cover is removably arranged between said battery housing and said securable battery cover, and access to said inner batter cover is granted by removing said securable battery cover.

10. The device of claim 9, wherein said battery housing comprises a main body including an inner body portion and an outer body portion, said inner and outer body portions arranged in alignment along a radius of said ball body, said inner and outer housing bodies comprising radially aligned cavities for a radially stacked arrangement of said at least one battery and said inner battery cover.

11. The device of claim 10, wherein, in the closed position, said securable battery cover is in radially-stacked arrangement with said at least one battery and said inner battery cover, and wherein, in the open position, said securable battery cover is rotated out of said stacked arrangement.

12. The handheld tethered ball device of claim 10, said ball unit further comprising at least one screw extending between and providing assembly of said inner body portion, said outer body portion and said outer securable battery cover.

13. A handheld tethered hall device, comprising:

a ball body, having an outer surface;

a ball retention cord, protruding from said ball body outer surface in a C-shaped configuration;

a tether assembly having a first end and an opposing second end, said tether assembly comprising:

a handle, arranged at said first end;

a cord, including a terminal loop arranged at said second end; wherein said ball retention cord is configured to allow passing of said tether assembly second end terminal loop between said ball retention cord and said ball outer surface, and wherein said tether assembly second end terminal loop is configured to allow passing of said tether assembly first end handle.

14. The device of claim 13, wherein said terminal loop is integral to the tether assembly cord.

15. The device of claim 14, wherein said tether assembly cord comprises an elongated cord body extending between a cord first end and a cord second end, wherein said cord body is looped rearwards forming said terminal loop, and wherein said second end is tied to the cord body in a sliding knot.

16. The device of claim 13, wherein said ball retention rd is coupled to and extends between two retention apertures in the ball body, said handheld tethered ball device further comprising an illumination assembly coupled within an aperture positioned between said at least two retention apertures.

17. A handheld tethered ball device, comprising:

a tether assembly having a first end and an opposing second end;

a ball unit, comprising:

a ball body, an illumination assembly configured to illuminate the ball body, said illumination assembly comprising at least one light source, a battery housing having a cavity for storing at least one battery for powering said at least one light source, and a securable battery cover for selectively concealing said cavity, wherein said securable battery cover is movable relative to said battery housing to adopt a closed position in which the securable battery cover conceals the cavity, and an open position in which the securable battery cover is moved away from the cavity and access to the cavity is granted, wherein at least one screw secures the securable battery cover to the battery housing in the closed position; wherein said tether assembly second end is removably attachable to said ball unit; and further wherein said illumination assembly further comprises an inner battery cover arranged radially below said securable battery cover, wherein said inner battery cover is removably arranged between said battery housing and said securable battery cover, and access to said inner batter cover is granted by removing said securable battery cover, wherein said battery housing comprises a main body including an inner body portion and an outer body portion, said inner and outer body portions arranged in alignment along a radius of said ball body, said inner and outer housing bodies comprising radially aligned cavities for a radially stacked arrangement of said at least one battery and said inner battery cover.

18. The device of claim 17, wherein, in the closed position, said securable battery cover is in radially-stacked arrangement with said at least one battery and said inner battery cover, and wherein, in the open position, said securable battery cover is rotated out of said stacked arrangement.

19. The device of claim 17, said ball unit further comprising at least one screw extending between and providing assembly of said inner body portion, said outer body portion and said outer securable battery cover.

* * * * *